US005433545A

United States Patent [19]

Keil

[11] Patent Number: 5,433,545

[45] Date of Patent: Jul. 18, 1995

[54] WRITING IMPLEMENT

[75] Inventor: Georg Keil, Gross-Bieberau, Germany

[73] Assignee: Merz & Krell GmbH & Co., Germany

[21] Appl. No.: 133,144

[22] PCT Filed: Apr. 10, 1992

[86] PCT No.: PCT/EP92/00820

§ 371 Date: Nov. 12, 1993

§ 102(e) Date: Nov. 12, 1993

[87] PCT Pub. No.: WO92/18339

PCT Pub. Date: Oct. 29, 1992

[30] Foreign Application Priority Data

Apr. 16, 1991 [DE] Germany ..... 41 12 420.0

[51] Int. Cl.[6] ..... B43K 8/02; B43K 8/10

[52] U.S. Cl. ..... 401/40; 401/41; 401/199

[58] Field of Search ..... 401/40, 41, 42, 43, 401/199

[56] References Cited

U.S. PATENT DOCUMENTS

| | | | |
|---|---|---|---|
| 1,947,092 | 2/1934 | Kingman | 401/41 |
| 1,978,676 | 10/1934 | Kingman | 401/41 |
| 1,998,930 | 4/1935 | Kingman . | |
| 3,290,717 | 12/1966 | Mizutani | 15/563 |
| 3,993,409 | 11/1976 | Hart | 401/199 |

FOREIGN PATENT DOCUMENTS

| | | | |
|---|---|---|---|
| 822542 | 12/1937 | France . | |
| 1408098 | 6/1965 | France | 401/199 |
| 1250302 | 9/1967 | Germany . | |
| 2124298 | 11/1972 | Germany | 401/199 |
| 2424918 | 12/1975 | Germany . | |
| 593299 | 5/1959 | Italy | 401/41 |
| 269816 | 7/1950 | Switzerland | 401/41 |
| 986411 | 3/1965 | United Kingdom . | |

OTHER PUBLICATIONS

English Translation of German Patent 1250302.

*Primary Examiner*—Steven A. Bratlie

*Attorney, Agent, or Firm*—Eckert Seamans Cherin & Mellott

[57] ABSTRACT

A felt tip pen, marker or liner having a casing, in which a reservoir containing a dry or pasty colored pigment is arranged such that it can be soaked with a liquid dissolving and absorbing the colored pigment. A wick like connecting element capable of capillary action penetrates both ends of the reservoir and is in contact with the dry or pasty colored pigment. The rear end of the wick like connecting element is in contact with a supply of liquid. The liquid is drawn through the wick like element by capillary action and the dry or pasty colored pigment is dissolved and mixed with the liquid as the liquid is drawn through the wick like element. The resulting writing material is drawn to the front end of the wick like connecting element and is deposited in a writing material reservoir. A writing tip capable of capillary action is arranged such that it is in contact with the writing material supply. The writing material is drawn though the writing tip by capillary action.

8 Claims, 1 Drawing Sheet

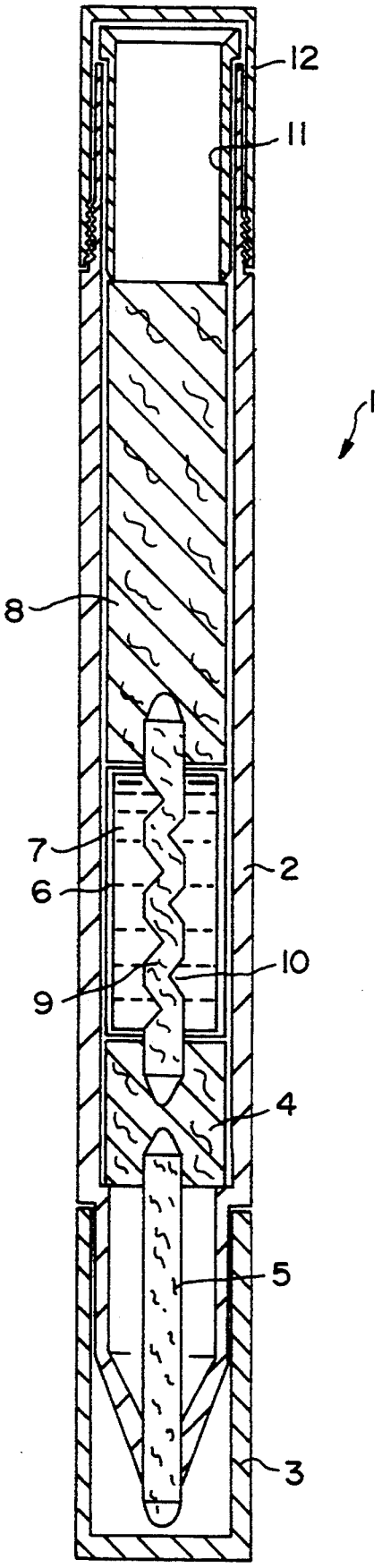
FIG. 1
FIG. 2
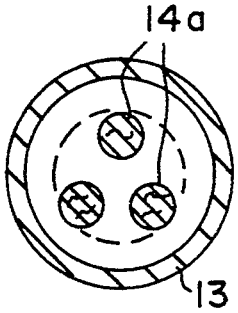
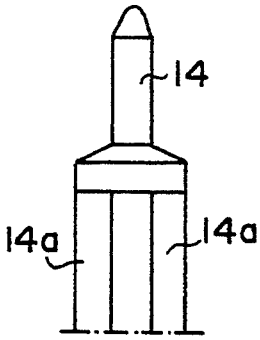
FIG. 3
FIG. 4
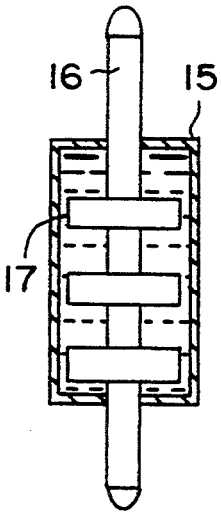
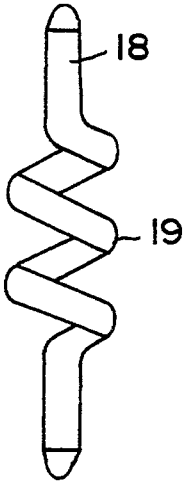
FIG. 5
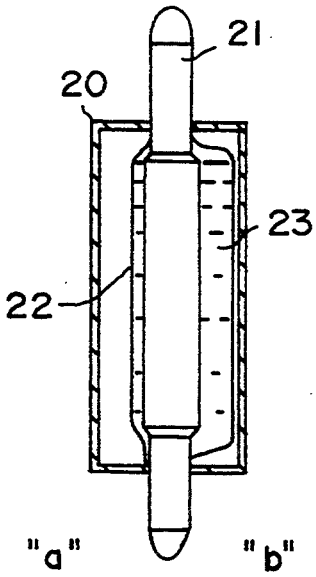
FIG. 6

WRITING IMPLEMENT

BACKGROUND OF THE INVENTION

1. Field of the Invention

This invention relates to the field of writing implements. More specifically this invention relates to a writing implement in the form of a felt tip pen, marker, liner having a casing, in which a reservoir containing a dry or pasty colored pigment is arranged such that it can be soaked with a liquid dissolving and absorbing the colored pigment and in which a writing tip of capillary material is in contact with the reservoir, which contact ensures the delivery of the writing liquid formed of colored pigment and liquid.

2. Prior Art

All kinds of writing implements having a liquid writing material are known. The writing material reservoir may consist of a refillable reservoir or of exchangeable cartridges. In the case of felt tip pens or the like a tampon or similar capillary reservoir is provided in the casing, which when processed is filled with a predetermined supply of ready-to-use writing material.

The former systems present difficulties for various reasons. Refillable fountain pens having a suction system are hardly used today due to the expenditure and the complicated refilling systems involving the danger of soiling. The cartridges widely spread instead pose environmental problems as regards the waste resulting from the empty cartridges and the packages thereof. Furthermore, the shops have to store corresponding cartridges with varying colored pigments.

Writing implements having a writing material reservoir incorporated into the casing and filled when processed with the writing material, have the drawback that the writing material supply is relatively limited. Another substantial drawback consists in that prolonged storage includes the danger of drying out, so that the writing implement is no longer usable or fails early before the filled-in pigment supply is actually consumed.

SUMMARY OF THE INVENTION

It is the object of this invention to encounter the indicated problems in a simple and effective manner. According to on aspect of the invention there is provided a writing implement in the form of a felt tip pen, marker, liner having a casing, in which a reservoir containing a dry or pasty colored pigment is arranged such that it can be soaked with a liquid dissolving and absorbing the colored pigment and in which a writing tip of capillary material is in contact with the reservoir, which contact ensures the delivery of the writing liquid formed of colored pigment and liquid characterized in that in the casing, in series arrangement with the reservoir containing the dry colored pigment, a reservoir is arranged which can be replenished and/or refilled and absorbs the dissolvent liquid on one side thereof and a writing liquid reservoir is arranged on the other side thereof, and that at least one connecting element having capillary action and penetrating the reservoir containing the colored pigment is provided, which element projects into both the replenishable and/or refillable liquid reservoir and the writing liquid reservoir.

This problem is solved substantially in that in addition to the writing material supply which is in direct contact with the writing tip a colored pigment supply, on the one hand, and a liquid reservoir, on the other hand, are provided separately in the casing, which are in capillary flow communication with one another and with the writing material supply.

A special advantage is represented by the fact that the colored pigments of the colored pigment supply are dissolved or absorbed by and mixed with the liquid as according to the consumption of the writing material resulting from the use of the writing implement. In this case, the writing material reservoir only has the function of providing for an additional mixture and uniform supply of the writing liquid to the writing tip.

The writing liquid can virtually be produced by the user of the writing implement himself when he uses the writing implement for the first time. For this purpose, it is only necessary to fill a predetermined amount of suitable liquid into the casing or the liquid reservoir. In this connection, the liquid in consideration is water or alcohol such as spirit or the like. The liquid is sucked up by the liquid reservoir and via the capillary element it contacts initially the colored pigment supply, dissolves a corresponding amount if colored pigment out of this supply and transports the colored pigments mixed with the liquid through capillary channels into the writing material supply which feeds the writing tip as usual. As a rule, only few moments (2 to 2 minutes) are required until—after filling in the liquid—the writing implement is ready for writing.

In this way, the writing implement becomes infinitely storable after its production and before its first use. The user can rely on the fact that the full writing period, corresponding to the amount of colored pigment supply, is actually available when he puts into use the writing implement. Even if the writing implement was filled with a great amount of colored pigment, the liquid reservoir only has to have a limited reservoir volume, since the liquid reservoir can be replenished or refilled with the required liquid amount at any time.

Cartridges and their packages are no longer required for refilling, so that the accompanying waste problems do not occur. Also, it is not necessary that the shops have a supply of cartridges for differing coloration.

On the other hand, no expensive suction systems as for ink-type fountain pens are required. No problems of soiling occur during refilling, since the liquid to be refilled does not contain any pigments. Thus, clean refilling is possible at any time.

Nevertheless, the writing implement may have a long service life, since the dry or pasty colored pigment is stored in the writing implement at a high concentration and thus in sufficient amount.

BRIEF DESCRIPTION OF THE DRAWINGS

The invention is explained below by means of diagrammatic drawings on the basis of several embodiments.

FIG. 1 shows a longitudinal section through a writing implement in an embodiment according to the invention;

FIG. 2 shows a cross-section at the height of the pigment supply in a modified embodiment;

FIG. 3 shows a partial view of the wick used in the embodiment according to FIG. 2;

FIG. 4 shows a section of a modified embodiment of the colored pigment supply;

FIG. 5 shows a side view of a modified embodiment of the connecting element, and FIG. 6 shows a vertical section of a further modified embodiment of the colored pigment supply.

DETAILED DESCRIPTION OF THE PREFERRED EMBODIMENTS

FIG. 1 illustrates a first embodiment of the new writing implement 1. The implement includes an oblong cylindrical hollow casing 2, the front end of which is developed as a holder for a writing tip 5. It is assumed that this embodiment concerns a felt tip pen. The rear end of the writing tip 5 is in constant direct contact with a small reservoir element 4 for a writing material supply. When not used, the writing tip can be externally protected from and covered by a slip-on cap 3.

A chamber or a cartridge 6 is arranged behind the writing material supply 4, and contains a powdery or pasty pigment supply 7. A relatively large reservoir 8 for a liquid adjoins the pigment supply. The liquid can be filled in or refilled via a filler neck 11 at the end of the casing 2 facing away from the writing tip 5. The filler neck 11 is sealingly closable by a screw cap 12. The screw cap 12 is advantageously developed as a measuring cup at the same time, so that the user does not have to pay special attention to the amount of liquid to be filled in.

The writing material supply 4, the colored pigment 7 and the liquid in the reservoir 8 are in capillary flow communication with one another. A wick-like connecting element 9 is used for this purpose. It penetrates the pigment supply 7 and projects into both the reservoir 8 and the writing material supply 4 so as to join the three areas in a capillary fashion with one another.

The connecting element 9 insures that after filling the liquid into the reservoir 8, part of the liquid is supplied into the chamber containing the pigment supply 6 where it contacts the pigment. The pigment is mixed with and dissolved or absorbed by the liquid to form the writing material. The writing material is transported into the writing material reservoir 4 which supplies the writing tip 5 with the writing material.

The user fills in the liquid. Depending on the type of pigment it is possible to use water or alcohol such as spirit or the like. The writing implement is ready for writing few minutes after filling in the liquid. When the writing power of the writing pencil decreases, the user can replenish the reservoir 8 with a measured quantity of liquid. This procedure can be repeated until the pigment supply 7 is consumed or the writing tip 5 is worn excessively. This system can also used for those writing implements whose writing tips can be exchanged so as to obtain a long service life.

Dry pigment or pigment in the form of a paste can be provided in chamber 6.

In order to guarantee the contact between wick element 9 and pigment when the pigment supply decreases, various measures may be used individually or in combination.

FIGS. 2 and 3 show a wick element 14 split in the area of the pigment supply into several parallel wick elements 14*a* which spread over the cross-section of the pigment supply 13.

According to the embodiment of FIG. 4, the wick element 16 has several cross-sectional widenings within the pigment reservoir 15, such as the disk-like widenings 17.

However, the wick element may also be shaped in a special way. FIG. 5 shows a wick element 18 which is developed as a spiral or screw in the area of pigment supply.

The arrangement can also be made such that the pigment supply and the wick element are constantly kept in mutual contact under pressure.

FIG. 6 shows a wick element 21 which penetrates the pigment supply 23. A resiliently extensible tube element 22 is provided in the cartridge or chamber 22, which in its relaxed state corresponds approximately to the shape in the left-hand half "a" of FIG. 6. The resiliently extensible tube element 22 is resiliently widened by falling in the colored pigment so as to adopt the shape according to the right-hand half "b" of FIG. 6 thereby keeping the pigment supply under pressure.

However, there are also other possibilities to extend the wick element resiliently by maintaining the contact or keeping the pigment supply under pressure as according to a piston/cylinder arrangement.

However, it has turned out that the normal movement of the writing implement and the changing positions always provide for a sufficient contact between the capillary connecting element and the pigment supply. Nevertheless, it is useful to keep the contact surface in the region of the supply relatively large so as to ensure good absorption of the pigment by the liquid and good intermixing. The lateral recesses 10 shown e.g. in FIG. 1 and disposed in the connecting element may be useful for this purpose.

The new writing implement is simple as regards its design, can easily be produced and assembled in clean manner, since it is not necessary to fill in liquid writing material during the manufacture. The consistency of the pigment supply in the reservoir 6 is such that a migration of the pigments into the writing material supply 4 and thus into the writing tip 5 cannot occur prior to the first putting into use without filling in the liquid. This also applies when the pigments have a pasty consistency.

We claim:

1. A writing implement comprising:

a casing in which a chamber containing a dry pigment is arranged such that it can be soaked with a solvent dissolving and absorbing the dry pigment to form a writing fluid, the dry pigment chamber having opposite sides;

a writing tip of capillary material mounted to the casing;

the casing defining, in series arrangement with the dry pigment chamber, a solvent reservoir and a writing fluid;

the solvent reservoir, which can be replenished with solvent, being adjacent one side of the dry pigment chamber;

the writing fluid reservoir arranged adjacent the other side of the dry pigment chamber; and, at least one connecting element having capillary action and extending through the dry pigment chamber, which element projects through the opposite sides of the dry pigment chamber and into both the solvent reservoir and the writing fluid reservoir, wherein the writing tip communicates with the writing fluid reservoir for delivery of the writing fluid.

2. The writing implement according to claim 1, wherein the connecting element operates in a wick-like fashion.

3. The writing implement according to claim 1, wherein the connecting element includes, one of recesses, profiles, shoulders and segregations promoting the dissolution and absorption of the pigment by the solvent.

4. The writing implement according to claim 2, wherein the dry pigment and the connecting element are kept in mutual contact under pressure.

5. The writing implement according to claim 4, wherein the dry pigment chamber has at least one wall resiliently expanded or prestressed in the filled state.

6. The writing implement according to claim 1, wherein the writing fluid reservoir is small as compared to the solvent reservoir.

7. The writing implement according to claim 2, further comprising a filler neck in one end of the casing opposite to the other end to which the writing tip is mounted; the filler neck permitting replenishment of the solvent.

8. The writing implement according to claim 7, further comprising a closure cap operably closing the filler neck, the closure cap additionally operable as a measuring cup for solvent.

* * * * *

UNITED STATES PATENT AND TRADEMARK OFFICE

CERTIFICATE OF CORRECTION

PATENT NO. : 5,433,545

DATED : July 18, 1995

INVENTOR(S) : Georg Keil

It is certified that error appears in the above-indentified patent and that said Letters Patent is hereby corrected as shown below:

Column 5, Claim 3, line 2, after the word :the" and before the word "pigment", insert the word —dry—.

Signed and Sealed this

Nineteenth Day of March, 1996

*Attest:*

*Attesting Officer*

BRUCE LEHMAN

*Commissioner of Patents and Trademarks*